US010745972B2

(12) United States Patent
Lejon et al.

(10) Patent No.: US 10,745,972 B2
(45) Date of Patent: Aug. 18, 2020

(54) SHANK ADAPTOR WITH REINFORCED FLUSHING SLOT

(71) Applicant: SANDVIK INTELLECTUAL PROPERTY AB, Sandviken (SE)

(72) Inventors: Susanne Lejon, Kungsgarden (SE); Magnus Persson, Sandviken (SE); Tomas Sh Jansson, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 188 days.

(21) Appl. No.: 15/310,202

(22) PCT Filed: May 4, 2015

(86) PCT No.: PCT/EP2015/059686
§ 371 (c)(1),
(2) Date: Nov. 10, 2016

(87) PCT Pub. No.: WO2015/173045
PCT Pub. Date: Nov. 19, 2015

(65) Prior Publication Data

US 2017/0145756 A1 May 25, 2017

(30) Foreign Application Priority Data

May 13, 2014 (EP) ..... 14168027

(51) Int. Cl.

| | |
|---|---|
| ***E21B 10/38*** | (2006.01) |
| ***E21B 10/36*** | (2006.01) |
| ***E21B 10/60*** | (2006.01) |
| ***E21B 17/03*** | (2006.01) |
| ***E21B 1/00*** | (2006.01) |
| ***E21B 21/00*** | (2006.01) |

(52) U.S. Cl.
CPC ..... *E21B 10/38* (2013.01); *E21B 1/00* (2013.01); *E21B 10/36* (2013.01); *E21B 10/60* (2013.01); *E21B 17/03* (2013.01); *E21B 21/00* (2013.01)

(58) Field of Classification Search
CPC . E21B 1/00; E21B 10/36; E21B 10/38; E21B 10/60; E21B 17/03
See application file for complete search history.

(56) References Cited

U.S. PATENT DOCUMENTS

| | | | | |
|---|---|---|---|---|
| 6,109,620 | A | 8/2000 | Roberts et al. | |
| 6,712,163 | B2 | 3/2004 | Kleine et al. | |
| 2002/0121391 | A1* | 9/2002 | Kleine | E21B 17/03 175/320 |

(Continued)

FOREIGN PATENT DOCUMENTS

| | | | |
|---|---|---|---|
| CA | 2247842 | A1 | 8/1997 |
| GB | 2352671 | A | 2/2001 |

(Continued)

*Primary Examiner* — Tara E Schimpf
(74) *Attorney, Agent, or Firm* — Corinne R. Gorski

(57) ABSTRACT

A rock drilling shank adaptor includes an elongate body having an internal flushing bore and an entry hole through the sidewall of the adaptor in fluid communication with the internal bore. The adaptor wall at the region of the entry hole is reinforced such that an internal diameter of the flushing bore at the reinforced region is less than an internal diameter of the bore at a position axially beyond the reinforced region.

12 Claims, 3 Drawing Sheets

(56) References Cited

U.S. PATENT DOCUMENTS

| | | | |
|---|---|---|---|
| 2005/0208224 | A1 | 9/2005 | Stenberg |
| 2011/0073373 | A1 | 3/2011 | Rodert et al. |

FOREIGN PATENT DOCUMENTS

| | | | | |
|---|---|---|---|---|
| WO | 03/078788 | A1 | 9/2003 | |
| WO | 2004079152 | A1 | 9/2004 | |
| WO | 2012032485 | A2 | 3/2012 | |
| WO | WO-2012032485 | A2 * | 3/2012 | ..... E21B 17/03 |

* cited by examiner

SHANK ADAPTOR WITH REINFORCED FLUSHING SLOT

RELATED APPLICATION DATA

This application is a § 371 National Stage Application of PCT International Application No. PCT/EP2015/059686 filed May 4, 2015 claiming priority of EP Application No. 14168027.2, filed May 13, 2014.

FIELD OF INVENTION

The present invention relates to a rock drilling shank adaptor having a reinforced flushing hole region, and in particular although not exclusively, to a flush hole region of the adaptor having a generally increased cross section area relative to an axial position along the adaptor beyond the reinforced region.

BACKGROUND ART

Percussion drilling is a well-established technique that breaks rock by hammering impacts transferred from the rock drill bit, mounted at one end of a drill string, to the rock at the bottom of the borehole. The energy needed to break the rock is generated by a hydraulically driven piston that contacts a shank adaptor positioned at the opposite end of the drill string to the drill tool. The piston strike on the adaptor creates a stress (or shock) wave that propagates through the drill string and ultimately to the borehole rock bottom.

Shank adaptors typically comprise an internal bore to allow transfer of a flushing fluid to the region of the drill tool. The flushing fluid acts to both cool the tool and to expel drill cuttings and fines from the bore hole. Conventionally, the fluid is introduced into the shank adaptor via a radially extending hole in the adaptor wall that is submerged within a fluid tank that seals onto the external surface of the adaptor axially either side of the hole. Example shank adaptors with internal flushing bores are described in CA 2,247,842; GB 2352671; WO 2012/032485 and WO 2004/079152.

A common problem with existing shank adaptors is the susceptibility for the adaptor wall to fracture with a crack originating and propagating from the flush hole due, in part, to the compressive and tensile stresses generated by the percussive piston and in particular the shock wave that is transmitted through the adaptor to the drill string and ultimately the drill tool. In underground applications, crack initiation is assisted by cavitational damage that exacerbates the problem. Shank adaptor failure is a particular problem for users as it often destroys the rubber seals at the fluid housing surrounding the adaptor. Time consuming replacement in repair of components is required resulting in very undesirable machine downtime. WO 2004/079152 discloses a flushing hole that attempts to reduce the stress at the region of the hole to mitigate fracture. However, there still exists a need for a shank adaptor having a flushing hole that further reduces or eliminates the likelihood of fracture in response to both compressive and tensile forces imparted and transmitted through the adaptor.

SUMMARY OF THE INVENTION

It is an objective of the present invention to provide a rock drilling shank adaptor having an entry hole for the introduction of a flushing fluid into the longitudinal flushing bore of the adaptor configured to minimise or eliminate the likelihood of fracture of the adaptor wall via a crack propagating from the flushing hole. It is a further objective to provide a shank adaptor configured to withstand the tensile and compressive forces experienced at the region of the flushing hole.

The objectives are achieved by reinforcing the wall of the shank adaptor at the region of the flushing hole such that a wall thickness at the region of the hole is greater than a corresponding wall thickness at a position axially beyond the reinforced region. The reinforced region may be further defined by reference to the relative cross sectional areas of the adaptor body and/or an internal diameter of the longitudinal flushing bore at different respective axial positions along the length of the adaptor. In particular, the objectives are also achieved by configuring the shank adaptor with a cross sectional area at the axially reinforced region (at the flush hole) that is equal to or greater than a cross sectional area of the adaptor at the axial position beyond the reinforced region. Increasing the wall thickness and cross sectional area at the flush hole region is effective to reduce the localised stress concentrations in the adaptor wall to effectively compensate for the relative reduction in the cross sectional area of the shank body due to the presence of two diametrically opposed bores that each function as the flushing hole. The relative increase in the cross sectional area and wall thickness at the region of the flushing hole is achieved by increasing the wall thickness radially inward towards the central longitudinal axis. Accordingly, an external diameter of the shank adaptor is unchanged whilst the internal diameter of the longitudinal flushing bore is less than the internal diameter at the position axially beyond the reinforced region.

According to a first aspect of the present invention there is provided a rock drilling shank adaptor comprising: an elongate body having a first end to be positioned towards a piston and a second end to be positioned towards a drill string; the body having an axially extending internal bore to allow passage of a flushing fluid to the drill string via the second end; characterised in that: the adaptor comprises not more than two flush holes extending radially through the body to the internal bore; and a cross sectional area of the body at an axially reinforced region at the flush hole(s) is equal to or greater than a cross sectional area of the body at an axial position of the internal bore axially beyond the reinforced region.

Reference within this specification to 'a cross sectional area of the body' refer to a cross section aligned perpendicular to a longitudinal axis of the elongate body.

Preferably, the reinforced region extends axially either side or at least to one side of the flush hole(s) such that a cross sectional area of the body to at least one axial side of the flush hole(s) is greater than the cross sectional area of the body at a position along the length of the internal bore axially beyond the reinforced region. Such a configuration is beneficial to provide distribution of the stress concentrations at the region of the flush hole to reduce the fatigue and the likelihood of cracks both initiating and propagating at the region of the flush hole. The present configuration is therefore advantageous to significantly increase the service life of the adaptor.

Preferably, the reinforcement of the shank adaptor may be defined in that a wall thickness of the body at the reinforced region is greater than a wall thickness of the body at the position axially beyond the reinforced region. So as to maintain a substantially uniform external diameter along a length region of the shank adaptor, an internal diameter of the body at the reinforced region is preferably less than an internal diameter of the body at the position axially beyond the reinforced region. Accordingly, the volume of material at the reinforced region is greater than the volume of material of the adaptor that defines the adaptor wall at a region axially beyond the reinforced region.

Preferably, the cross sectional area of the body at an axial position of the flush hole(s) is in the range 0% to 50% or 0% to 40%. Optionally, a cross sectional area of the body at an axial position within the reinforced region but to one axial side of the flush hole(s) is in the range 10 to 50%, 20 to 40% or 25% to 35% greater than the cross sectional area at the position axially beyond the reinforced region. The relative increate in the cross sectional area is accordingly configured to delocalise the stresses at the region of the flush hole due to the percussive piston and in particular the shock wave that is transmitted through the adaptor. These advantages are accordingly achieved via a wall thickness of the body at the reinforced region is 30% to 60% or 35% to 50% or more preferably 38% to 48% greater than the wall thickness at the position axially beyond the reinforced region. The present configuration has been found to both reduce the localisation of stress concentrations that would otherwise lead to crack initiation and propagation and to reduce the impedance mismatch. Optionally and to further minimise any impedance mismatch, an axial length of the reinforced region is in the range 2% to 20%, 4% to 15% or 6% to 10% and more preferably 7% to 9% of a total axial length of the adaptor.

Preferably, the cross sectional area of the body decreases in the axial direction from the reinforced region to the position axially beyond the reinforced region via a gradual tapered profile. That is, the internal diameter of the axial bore may be considered to increase in a linear or non-linear manner at the transition from the reinforced region and the remaining main length of the adaptor at the region of the internal bore. Optionally, the internal facing surface of the axial bore may be curved at the transition region so as to define a segment of the outer surface of a sphere.

Optionally, the flush hole comprises a shape profile configured to reduce stresses at the flush hole region. Optionally, a shape profile of the flush hole (in a plane parallel to the longitudinal axis) is oval or comprises curved sections. Optionally, the flush hole(s) comprise a super ellipse shape profile.

Preferably, an internal diameter of the body at the reinforced region is less than an internal diameter of the body at the position axially beyond the reinforced region.

According to a second aspect of the present invention there is provided rock drilling apparatus comprising a shank adaptor as claimed herein.

Optionally, the apparatus further comprises an elongate piston having a main length and an energy transmission end to contact the first end of the adaptor; and a drill string formed from a plurality of coupled elongate rods wherein a rearwardmost drill rod of the string is coupled to the second end of the adaptor.

The relative cross sectional area, wall thickness and/or internal diameter of the shank adaptor at the reinforced region and/or the axial length of the reinforced region is configured specifically such that impedance mismatch between the adaptor and the rearwardmost drill rod is less than 5% and preferably less than 2%.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
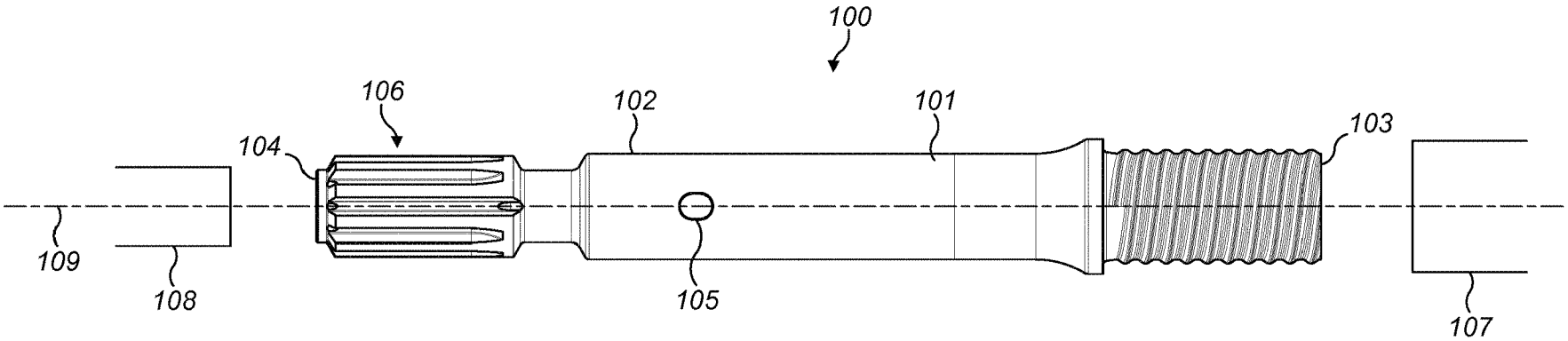
FIG. 1 is an external view of shank adaptor forming part of a rock drilling apparatus comprising an elongate drill string and a hydraulically driven reciprocating piston according to a specific implementation of the present invention.

Referring to FIG. 1, rock drilling apparatus comprises an elongate energy transmission adaptor 100 comprising a main body (or length section) 101 having a forward end 103 and a rearward end 104 relative to a longitudinal axis 109. A plurality of axially parallel elongate splines 106 project radially outward from an external surface 102 at a rearward region of elongate main body 101 towards rearward end 104. Splines 106 are configured to be engaged by corresponding splines of a rotational motor (not shown) to induce rotation of adaptor 100 about axis 109 during drilling operations. Adaptor 100 further comprises a flush hole (or bore) 105 positioned axially between ends 103, 104 and extending radially through the adaptor main body 101 from external surface 102 to an internal cavity or region extending axially within adaptor 100.

Adaptor 100 is configured for coupling to an elongate drill string and to allow transmission of a stress wave to a drill tool (not shown) located at the deepest region of the drill hole to impart the percussion drilling action. In particular, adaptor forward end 103 may be coupled to a rearward end of a rearwardmost elongate drill rod 107 forming a part of the drill string. The rearwardmost adaptor end 104 is configured to be contacted by a hydraulically driven piston 108 that creates the stress wave within adaptor 100 and the drill string. Such apparatus further comprises a flushing fluid tank and associated seals, valves and pumps (not shown) positioned external around adaptor surface 102 such that flush hole 105 is submerged within the tank to allow introduction of the fluid into adaptor 100 and subsequently axially through the elongate drill rods 107.

Figure 2:
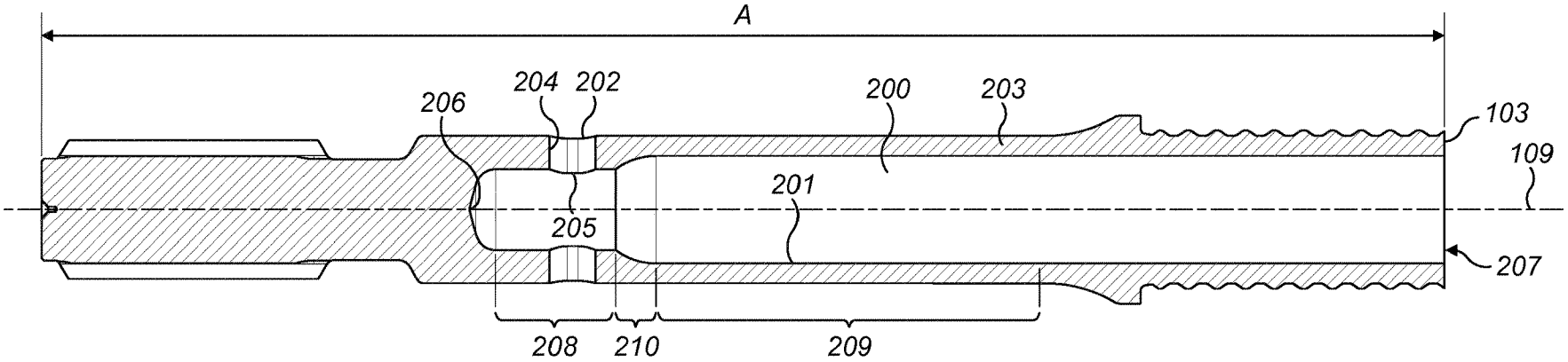
FIG. 2 is a cross sectional side view through the adaptor of FIG. 1.
Figure 3:
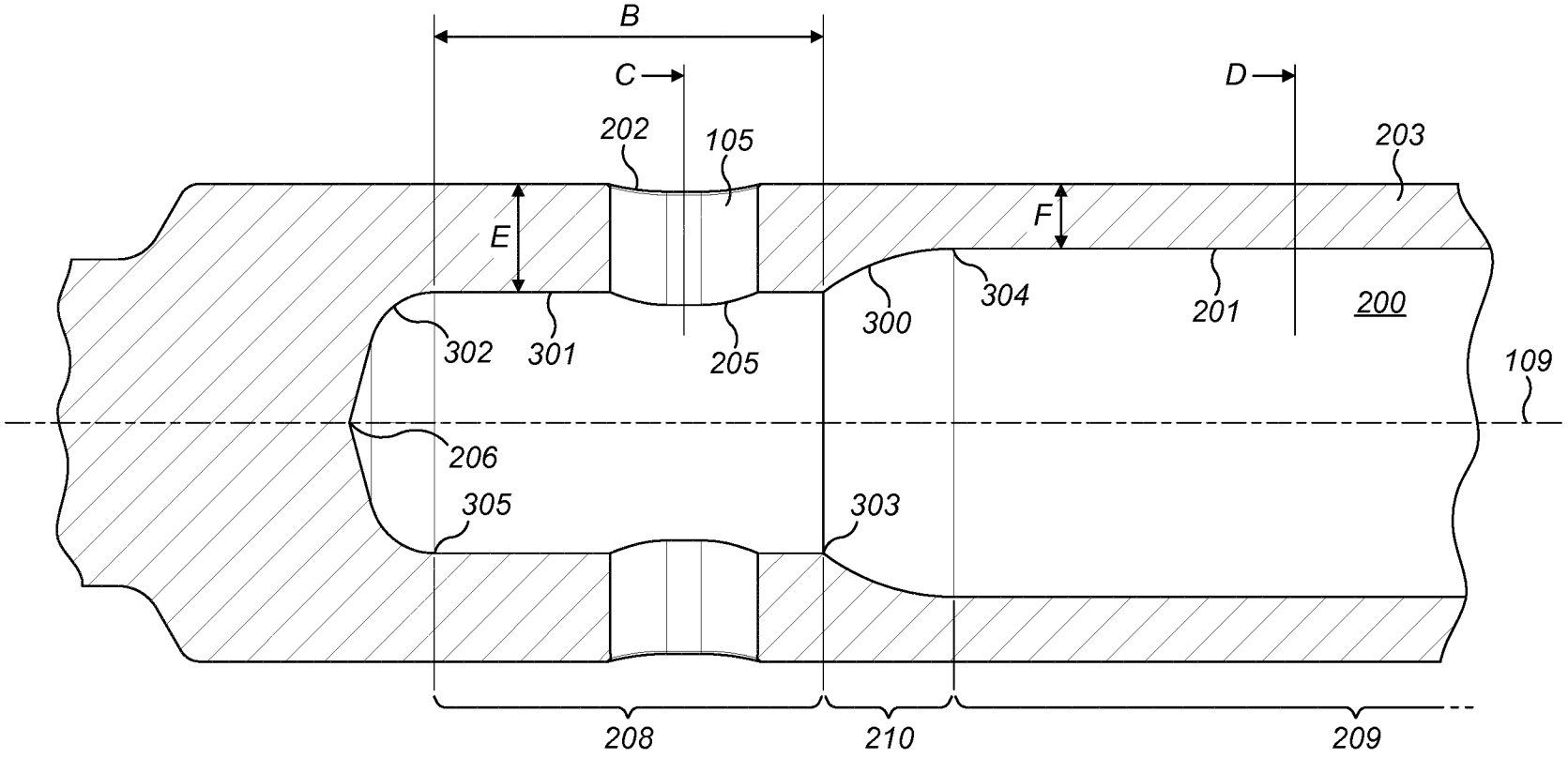
FIG. 3 is a magnified cross sectional view of a reinforced region of the shank adaptor of FIG. 2.

Referring to FIGS. 2 and 3, adaptor 100 comprises an internal elongate bore 200 extending axially from the region of hole 105 to forwardmost end 103. In particular, bore 200 comprises a rearwardmost end 206 and an open forwardmost end 207 positioned in fluid communication with the internal bore (not shown) extending through each drill rod 107.

Hole 105 is defined by an external edge 202 having a closed loop configuration in which the loop comprises straight regions and curved regions. Hole 105 extends radially through adaptor wall 203 from external surface 102 to internal surface 201 that defines internal bore 200. Accordingly, flush hole 105 is further defined by an innermost or internal edge 205 having an identical shape profile to the external edge 202, with edges 202, 205 coupled by a radially extending surface 204, aligned perpendicular to axis 109, that defines the radial wall of bore hole 105. Surface 204 is substantially straight and non-curved in a plane perpendicular to axis 109 such that a shape profile of hole 105 is uniform in a radial direction from external edge 202 to internal edge 205. In use, fluid is introduced into adaptor 100 via hole 105 and is then forced through bore 200 and into the rearwardmost drill rod 107 to provide the flushing of cuttings from the region around the drill tool (not shown) and cooling of both the drill rods 107 and cutting tool (as the adaptor 100 and rods 107 are rotated about axis 109 during cutting operations).

A part of the region of adaptor 100 corresponding to a position along the length of adaptor 100 comprises a reinforced region represented generally by reference 208 located towards bore rearwardmost end 206 relative to bore forwardmost end 207. A thickness of the adaptor wall 203 at reinforced region 208 is generally greater than a corresponding wall thickness at a position axially beyond this region 208, with this position indicated generally by reference 209. That is, the diameter of bore 200, as defined by the internal facing cylindrical surface 201 at the un-reinforced region 209 of the main length is greater than the corresponding diameter at the reinforced region 208, as defined by inward facing cylindrical surface 301. A transition region indicated generally by reference 210 is positioned axially intermediate regions 208 and 209. According to the specific implementation, the internal facing surface 300 at transition region 210 is curved so as to be concave relative to axis 109 between a rearwardmost end 303 and a forwardmost end 304. Rearward end 303 represents the axial junction between reinforced region 208 and transition region 210 and forward end 304 corresponds to the axial junction between transition region 210 and main length region 209. Reinforced region 208 is terminated at its rearwardmost end 305 by a conical or domed surface 302 that defines the rearwardmost bore end 206.

Accordingly, a cross section area through the body of adaptor 100 at the region of flush hole 105, corresponding to cross section C, is equal to or greater than a cross sectional area through the body of adaptor 100 at cross section D (located axially within main length of region 209). The relative increase in the cross sectional area of adaptor wall 203 is effective to strengthen the adaptor at and axially adjacent the location of the flush hole 105. Accordingly, the adaptor 100 at region 208 is effective withstand stress concentrations surrounding flush hole 105 due firstly to high stresses created by piston 108 and/or secondly to surface defects at and around flush hole 105 and in particular external and internal edges 202, 205.

Additionally, a wall thickness E of the reinforced region is in a range 35 to 50% greater than a wall thickness F within region 209. To further minimise energy losses through the adaptor 100 due to impedance mismatch and reduce stress concentrations at and around flush hole 105 an axial length B of the reinforced region 208 relative to a total axial length A of adaptor 100 is optimised. In particular, and according to the specific implementation, axial length B is approximately 8 to 12% of axial length A.

According to the specific implementation, reinforced region 208 extends axially forward and axially rearward of hole 105. Accordingly, the cross sectional area of body 101 within reinforced region 208 axially forward and axially rearward of hole 105 (axially adjacent section C) is greater than the corresponding cross sectional area at cross section D. Additionally and according to the specific implementation, the internal diameter of bore 200 at reinforced region 208 is substantially uniform between the region forwardmost end 303 (corresponding to the axial junction with transition region 210) and the region rearwardmost end 305 (corresponding to the axial junction with the conical or dome shaped end surface 302). Additionally, and as illustrated in FIGS. 2 and 3, the internal diameter of bore 200 as defined by inward facing surface 201 is substantially uniform along the length of main length region 209.

The invention claimed is:

1. A rock drilling shank adaptor comprising:

an elongate body having a first end and a second end relative to a longitudinal axis, the first end being arranged to be positioned towards a piston and the second end being arranged to be positioned towards a drill string, the body having an axially extending internal bore arranged to allow passage of a flushing fluid to the drill string via the second end;

not more than two flush holes extending radially through the body to the internal bore; and an axially reinforced region of the body including the flush holes, wherein a wall thickness of the body at the axially reinforced region is in a range of 35-50% greater than a wall thickness of the body at the axial position located beyond the axially reinforced region.

2. The adaptor as claimed in claim 1, wherein the axially reinforced region extends axially at either side or at least to one side of the flush holes such that a cross sectional area of the body to at least one axial side of the flush holes is greater than the cross sectional area of the body at the position of the internal bore axially beyond the axially reinforced region.

3. The adaptor as claimed in claim 1, wherein an axial length of the axially reinforced region is in the range 2% to 20% of a total axial length of the adaptor.

4. The adaptor as claimed in claim 3, wherein the range is 4% to 15%.

5. The adaptor as claimed in claim 1, wherein a cross sectional area of the body decreases in the axial direction from the reinforced region to the axial position axially beyond the reinforced region via a gradual tapered profile.

6. The adaptor as claimed in claim 1, wherein the flush holes each have a super ellipse shape profile.

7. The adaptor as claimed in claim 1, wherein an internal diameter of the body at the reinforced region is less than an internal diameter of the body at the axial position axially beyond the reinforced region.

8. The adaptor as claimed in claim 1, wherein each flush hole is defined by an internal edge located at the internal bore, the internal edge having an identical shape profile to an external edge located at an outer surface of the adapter, the internal and external edges being coupled by a radially extending surface that is aligned perpendicular to the longitudinal axis.

9. A rock drilling apparatus comprising:

an elongate piston;

a drill string; and a shank adaptor including an elongate body having a first end and a second end relative to a longitudinal axis, the first end being arranged to be positioned towards the piston and the second end being arranged to be positioned towards the drill string, the body having an axially extending internal bore to allow passage of a flushing fluid to the drill string via the second end, not more than two flush holes extending radially through the body to the internal bore, an axially reinforced region including the flush holes, and a wall thickness of the body at the axially reinforced region is in a range of 35-50% greater than a wall thickness of the body at the axial position located beyond the reinforced region.

10. The apparatus claimed in claim 9, wherein the elongate piston includes a main length and an energy transmission end arranged to contact the first end of the adaptor, the drill string being formed from a plurality of coupled elongate rods wherein a rearwardmost drill rod of the string is coupled to the second end of the adaptor.

11. The apparatus as claimed in claim 10, wherein the reinforced region is configured such that an impedance mismatch between the adaptor and the rearwardmost drill rod is less than 5%.

12. The apparatus as claimed in claim 10, wherein the reinforced region is configured such that an impedance mismatch between the adaptor and the rearwardmost drill rod is less than 2%.

* * * * *